US005335774A

United States Patent [19]

Ganz

[11] Patent Number: 5,335,774

[45] Date of Patent: Aug. 9, 1994

[54] CAN CARRIER

[75] Inventor: Robert H. Ganz, Saddle River, N.J.

[73] Assignee: Riverwood International Corporation, Atlanta, Ga.

[21] Appl. No.: 93,483

[22] Filed: Jul. 19, 1993

[51] Int. Cl.[5] ..... B65D 75/00

[52] U.S. Cl. ..... 206/153; 206/147; 206/148; 294/87.2

[58] Field of Search ..... 206/141, 147, 148, 149, 206/153, 154, 158, 199; 294/87.2

[56] References Cited

U.S. PATENT DOCUMENTS

| | | | |
|---|---|---|---|
| 2,965,410 | 12/1960 | Hughes . | |
| 3,094,210 | 6/1963 | Van Den Berg | 206/153 |
| 3,302,784 | 2/1967 | Coping | 206/153 |
| 3,653,503 | 4/1972 | Arneson | 206/153 |
| 3,674,136 | 7/1972 | Forrer | 206/153 |
| 4,095,693 | 6/1978 | Killy | 206/148 |
| 5,230,425 | 7/1993 | Edquist et al. | 206/153 |

*Primary Examiner*—David T. Fidei
*Attorney, Agent, or Firm*—Charles E. Brown

[57] ABSTRACT

This invention relates to a can carrier for forming into a package and carrying one or more cans, normally six cans to form a six-pack. The can carrier is primarily formed of a sheet of readly foldable and deformable material including paperboard. For each can, the sheet is provided with a pair of cutouts defining foldable flaps. The flaps are foldable beneath the sheet with each pair of flaps being remote from one another. The result is that the connection between each flap and the sheet provides two layers of materials which are engagable beneath a can chime to interlock the can with the can carrier. The folded connection between each flap and the sheet may be reinforced by stretchable self shrinking glue disposed generally in the apex of the connection between each flap and the under side of the sheet. Another form of flap reinforcement is the bonding of a synthetic thread to the under side of the sheet and the flaps with the thread extending longitudinally of the sheets and the flaps. The thread may be utilized with or without the glue. Finally, the upper surface of the sheet around the cutout may be provided with a layer of water resistant material so as to resist the absorption of water into the sheet surrounding each cutout. If desired, a central portion of the sheet may be provided with a pair of cutouts for defining flaps which may be pressed down between adjacent cans to define finger receiving openings for carrying the can package.

10 Claims, 2 Drawing Sheets

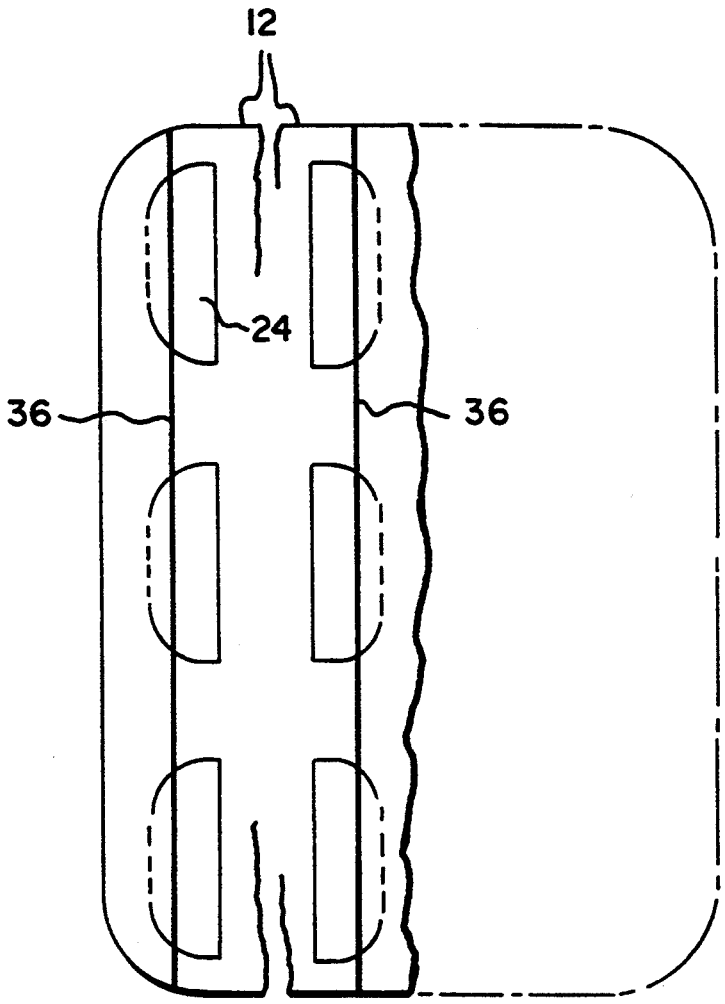
FIG. 4
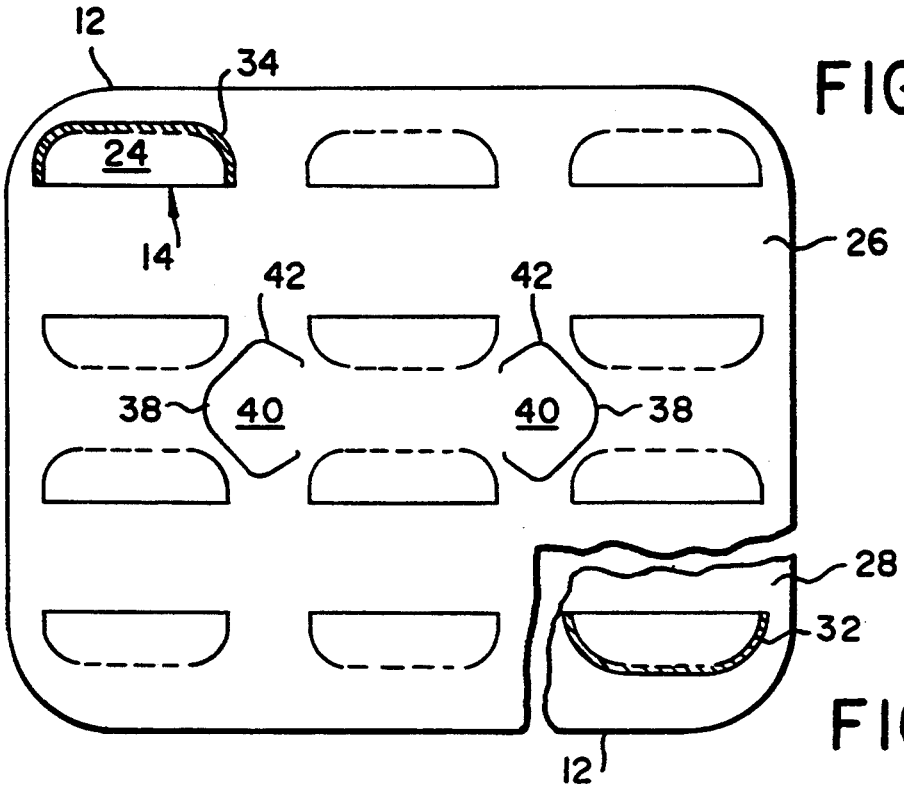
FIG. 5
FIG. 6

CAN CARRIER

This invention relates in general to new and useful improvements in can carriers, and more specifically to a can carrier in the form of a sheet of foldable and deformable material including paperboard which is provided with cutouts defined by folded flaps for interlocking engagement with the chime of a can.

BACKGROUND OF THE INVENTION

In the past, there has been developed a can carrier formed from a sheet of paperboard and the like wherein there are cutouts defined by folded flaps struck from cutouts. However, the chime of a can to be carried by the can carrier engages a single thickness of a sheet and when the can package, such as a six-pack of beer, is immersed in water, the can carrier becomes unduly weakened and releases the cans carried thereby in an undesirable manner. Such a can carrier is disclosed in the patent to Hughes, U.S. Pat. No. 2,965,410.

GENERAL DESCRIPTION OF INVENTION

In accordance with this invention, it is proposed to form a can carrier from a paperboard sheet wherein for each can there is a pair of cutouts having folded therefrom a pair of flaps. The fold lines for the flaps are remote from one another with the result that the flaps do not enter the cutout areas in use, but fold down exteriorly of the top portion of the can with the double thickness of the folded flaps engaging beneath the chime of the can. Thus, the can carrier is not subject to deterioration in the same manner as the prior art can carriers.

With the above and other objects in view that will hereinafter appear, the nature of the invention will be more clearly understood by reference to the following detailed description, the appended claims, and the several views illustrated in the accompanying drawings.

BRIEF DESCRIPTION OF THE DRAWINGS

FIG. 4 is a fragmentary plan view of a modified version of the can carrier of FIG. 1.

FIG. 5 is a fragmentary plan view of another form of the can carrier of FIG. 1.

FIG. 6 is a fragmentary bottom plan view of the can carrier of FIG. 1.

DESCRIPTION OF THE INVENTION

Figure 1:
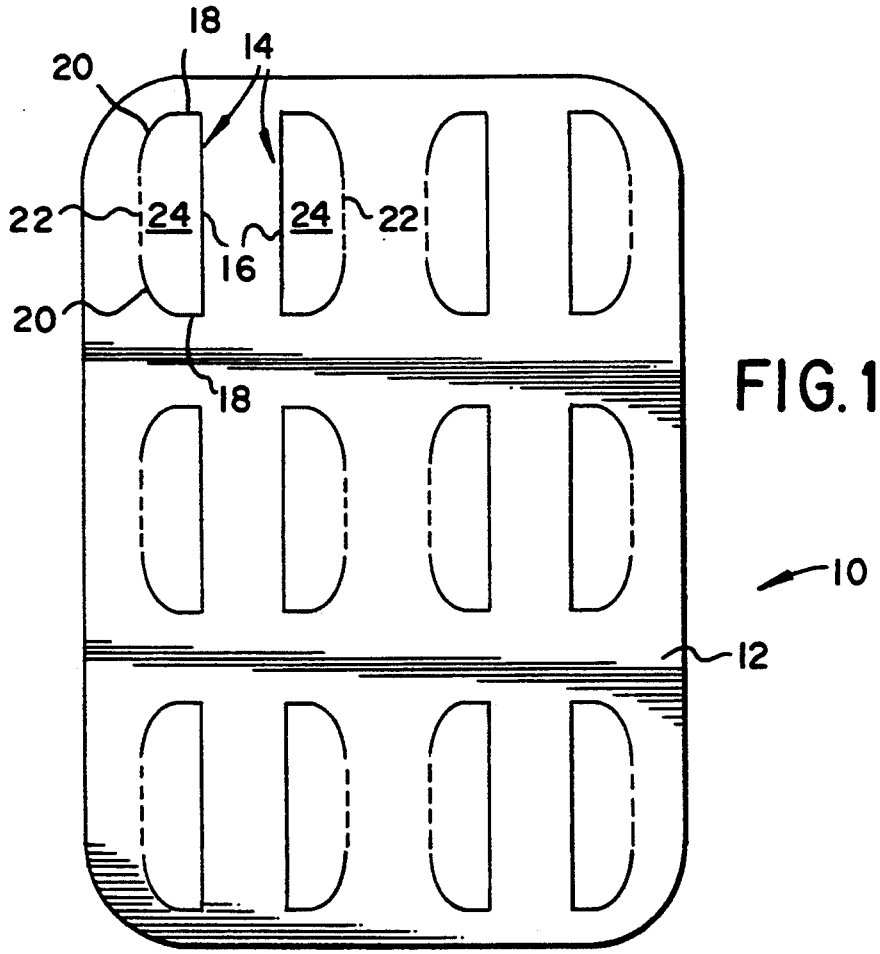
FIG. 1 is a plan view of a can carrier formed in accordance with this invention.

Referring now to the drawings in detail, it will be seen that there is illustrated in FIG. 1 a can carrier formed in accordance with this invention, the can carrier being generally identified by the numeral 10. The can carrier 10 is in the form of a sheet of foldable and slightly deformable material including paperboard. The sheet is identified by the numeral 12 and has formed therein two partial cutouts 14 for each can to be carried. Each cutout 14 includes a straight line cut 16 terminating at its ends in transversely extending short cut portions 18. The cut portions 18, in turn, terminate in curved cutout portions 20. The curved cutout portions

20 are separated by a longitudinal fold line 22 which extends parallel to the straight line cut 16.

The cutouts 14 of each pair of cutouts are arranged in left and right relation so that the fold lines 22 are disposed remote from one another. Each cutout 14 defines a flap 24 which is hingedly connected to the sheet 12 along the respective fold line 22.

Figure 2:
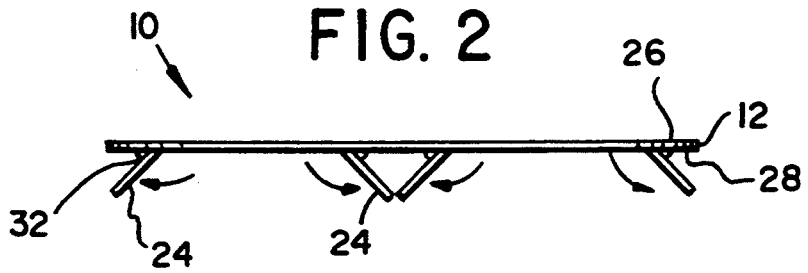
FIG. 2 is an end elevational view of the can carrier of FIG. 1 with the flaps thereof being folded out of the cutouts.

At this time it is pointed out that the sheet 12, as shown in FIG. 2, includes an upper surface 26 and an under surface 28. In use, the flaps 24 are struck downwardly beneath the under surface 28 and in diverging relation.

Figure 3:
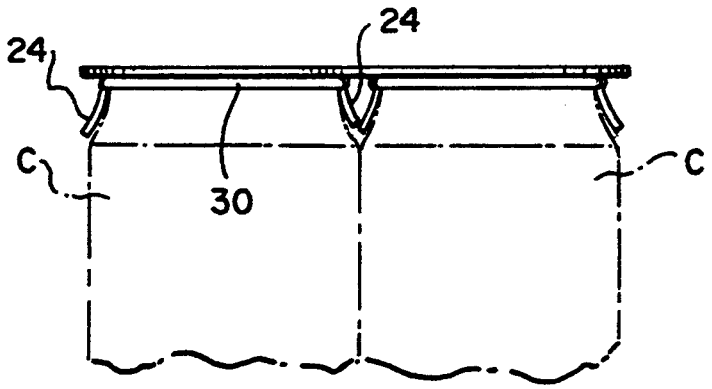
FIG. 3 is an end elevational view of a can package wherein cans are carried by the can carrier.

With the flaps 24 folded downwardly, the can carrier 10 is now ready to be engaged over the tops of cans C with chimes 40 of such cans snapping in between flaps 24 of an associated pair of flaps and interlocking with the doubled portions of such flaps and sheet as is clearly shown in FIG. 3.

Because of the arrangement and position of the flaps 24 and the fact that the chimes 30 of the cans C engage in double portions of the flaps and the sheet 12, it will be seen that the can carrier 10 is much stronger than prior somewhat similar can carriers.

As an added feature, as is best shown in FIG. 2, the sheet 12 may be provided on the under side 28 thereof adjacent each fold line 22 with a layer of shrinkable glue 32 that is stretched when the can carrier 10 is applied to a can C.

FIG. 6 is a fragmentary bottom plan view of one of the cutout areas and shows the application of the glue 32 to the under side 28 of the sheet 12.

In order to further strengthen the sheet 12 and protect it from deterioration by water about the periphery of the cutout 14, as is best shown in FIG. 5, the upper surface 26 of the sheet 12 may have printed thereon about the periphery of each cutout 14 a pattern of a water resistant material with the pattern being defined by the numeral 34. This prevents water from entering into the paperboard of the sheet 12 particularly along the cut edges thereof defining the cutout 14.

Each of the sheets 12 may be further reinforced by a longitudinal water resistant synthetic thread 36 which extends longitudinally of the sheet 12 as well as longitudinally of the flaps 24. The thread 36 is bonded to both the flaps 24 and the under surface of the sheet 12 as is most clearly shown in FIG. 4.

It is to be understood that the reinforcing threads 36 may be utilized either in conjunction with the glue 32 or the absence of the glue although the combination is preferred.

Finally, the sheet 12, as illustrated in FIG. 5, may be provided with a pair of centrally located, longitudinally spaced cut lines 38 which define the remote disposable flaps 40 which, when displaced, will define finger receiving openings to facilitate the carrying of the can package. The finger receiving openings will be identified by the numeral 42.

Although the illustrated can carrier is for receiving six cans so as to define a six-pack, it is to be understood that other arrangements of can receptacles than two rows of three cans each.

Although only preferred embodiments of the can carrier have been specifically illustrated and described herein, it is to be understood that minor variations may be made in the can carrier without departing from the spirit and scope of the invention as defined by the appended claims.

I claim:

1. A can carrier comprising a sheet of a foldable and deformable material including paperboard, said sheet having for each can to be packaged a pair of transversely aligned cutouts defining foldable flaps, each of said flaps being hingedly connected to said sheet along a longitudinal fold line, and said fold lines of each pair of flaps being remote from one another to define double thickness can retaining flaps arranged in opposed relation for engagement beneath a can chime, said sheet has an upper surface and an under surface, and said flaps of each pair of flaps are foldable from said sheet below said under surface in opposite remotely facing relation, said sheet under surface has thereon adjacent said fold line glue for retaining said flaps in folded positions relative to said sheet under surface.

2. A can carrier according to claim 1 wherein said glue is a stretchable self shrinking glue.

3. A can carrier according to claim 2 wherein said sheet upper surface has thereon around said cutout a waterproof coating protecting said sheet around said cutout.

4. A can carrier according to claim 1 wherein said sheet upper surface has thereon around said cutout a waterproof coating protecting said sheet around said cutout.

5. A can carrier according to claim 1 wherein each of said flaps has extending longitudinally across said flap and into adjacent portions of said sheet in bonded relation a reinforcing thread.

6. A can carrier according to claim 5 wherein said thread is bonded to the under surface of said sheet.

7. A can carrier according to claim 6 wherein said thread is formed of a synthetic water resistant material.

8. A can carrier comprising a sheet of a foldable and deformable material including paperboard, said sheet having for each can to be packaged a pair of transversely aligned cutouts defining foldable flaps, each of said flaps being hingedly connected to said sheet along a longitudinal fold line, and said fold lines of each pair of flaps being remote from one another to define double thickness can retaining flaps arranged in opposed relation for engagement beneath a can chime, said sheet has an upper surface and an under surface, and said flaps of each pair of flaps are foldable from said sheet below said under surface in opposite remotely facing relation, said sheet under surface has thereon adjacent said fold line glue for retaining said flaps in folded positions relative to said sheet under surface, each of said flaps has extending longitudinally across said flap and into adjacent portions of said sheet in bonded relation a reinforcing thread.

9. A can carrier according to claim 8 wherein said thread is bonded to the under surface of said sheet.

10. A can carrier according to claim 9 wherein said thread is formed of a synthetic water resistant material.

* * * * *